US009907341B1

(12) United States Patent
Zhu

(10) Patent No.: US 9,907,341 B1
(45) Date of Patent: Mar. 6, 2018

(54) E-LIQUID SEPARATION MECHANISM AND ELECTRONIC CIGARETTE HAVING THE SAME

(71) Applicant: SHENZHEN KANGER TECHNOLOGY CO., LTD., Shenzhen (CN)

(72) Inventor: Xiaochun Zhu, Shenzhen (CN)

(73) Assignee: SHENZHEN KANGER TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/456,529

(22) Filed: Mar. 12, 2017

(30) Foreign Application Priority Data

Mar. 9, 2017 (CN) ..... 2017 1 0138643

(51) Int. Cl.
*A24F 47/00* (2006.01)

(52) U.S. Cl.
CPC ..... *A24F 47/008* (2013.01)

(58) Field of Classification Search
CPC ..... A24F 47/008; A24F 47/002; A24F 47/004
USPC ..... 131/328, 329, 330
See application file for complete search history.

(56) References Cited

U.S. PATENT DOCUMENTS 8,205,622 B2 * 6/2012 Pan ..... A24F 47/008 131/273
2011/0011396 A1 * 1/2011 Fang ..... A24F 47/008 128/202.21
2011/0303231 A1 * 12/2011 Li ..... A24F 47/008 131/329
2013/0081642 A1 * 4/2013 Safari ..... A24F 47/008 131/329
2013/0192615 A1 * 8/2013 Tucker ..... H01C 17/00 131/328
2015/0020829 A1 * 1/2015 Li ..... A24F 47/008 131/329
2015/0272218 A1 * 10/2015 Chen ..... H05B 3/44 131/329

* cited by examiner

*Primary Examiner* — Harshad C Patel
(74) *Attorney, Agent, or Firm* — Ming Jiang; MM IP Services LLC

(57) ABSTRACT

The present disclosure relates to an E-liquid separation mechanism and electronic cigarettes having the E-liquid separation mechanism. The E-liquid separation mechanism includes an E-liquid storage tank assembly, and a vaporizer assembly. The E-liquid storage tank assembly and the vaporizer assembly are slidedly and rotatably connected through an E-liquid storage tank connector and a silicone gel sealing cover. When a user uses the electronic cigarette, the user pushes the E-liquid storage tank assembly down from an up position, and rotates the vaporizer assembly using an E-liquid separation control handler from a first position to a second position to allow E-liquid in the E-liquid storage tank to flow into a cylindrical E-liquid storage medium to be vaporized by one or more heating elements formed between a first E-liquid storage tank base opening and a first vaporizer E-liquid opening, and a second E-liquid storage tank base opening and a second vaporizer E-liquid opening.

20 Claims, 11 Drawing Sheets

E-LIQUID SEPARATION MECHANISM AND ELECTRONIC CIGARETTE HAVING THE SAME

FIELD

The present disclosure generally relates to the field of electronic cigarette, and more particularly to an E-liquid separation mechanism, electronic cigarettes having the E-liquid separation mechanism, and methods of using the electronic cigarettes having the E-liquid separation mechanism.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

It is well known that smoking cigarette is harmful to smoker's health. The active ingredient in a cigarette is mainly nicotine. During smoking, nicotine, along with tar aerosol droplets produced in the cigarette burning, are breathed into the alveolus and absorbed quickly by the smoker. Once nicotine is absorbed into the blood of the smoker, nicotine then produces its effect on the receptors of the smoker's central nervous system, causing the smoker relax and enjoy an inebriety similar to that produced by an exhilarant.

The electronic cigarette is sometimes referred as electronic vaporing device, personal vaporizer (PV), or electronic nicotine delivery system (ENDS). It is a battery-powered device which simulates tobacco smoking. It generally uses a heating element that vaporizes a liquid solution (e-liquid). Some solutions contain a mixture of nicotine and a variety of flavorings, while others release a flavored vapor without nicotine. Many are designed to simulate smoking experience, such as cigarette smoking or cigar smoking. Some of them are made with similar appearance, while others are made considerably different in appearance.

When E-liquid is filled in an electronic cigarette before shipment out of a factory, the E-liquid is always in contact with an E-liquid storage medium, and exposed to air causing vaporization. The oxidation of the E-liquid may cause certain bad smell or bad taste with users. Therefore, it is desirable to separate the E-liquid from the E-liquid storage medium before users are ready to use them, and/or between each use.

Therefore, an unaddressed need exists in the art to address the aforementioned deficiencies and inadequacies.

SUMMARY

In one aspect, the present disclosure relates to an E-liquid separation mechanism for an electronic cigarette. In certain embodiments, the E-liquid separation mechanism includes an E-liquid storage tank assembly, and a vaporizer assembly.

In certain embodiments, the E-liquid storage tank assembly includes an E-liquid storage tank storing E-liquid and an E-liquid storage tank base. The E-liquid storage tank base defines a first E-liquid storage tank base opening, and a second E-liquid storage tank base opening. The E-liquid storage tank stores the E-liquid between an external tube and an internal tube and the internal tube forms a vapor output. The E-liquid storage tank assembly also has a mouthpiece positioned on a top end of the E-liquid storage tank and connected to the vapor output. The E-liquid storage tank assembly may include an E-liquid storage tank sealing ring to prevent the E-liquid from the E-liquid storage tank from leaking into the vaporizer assembly.

In certain embodiments, the vaporizer assembly includes one or more heating elements positioned on a heating element base. The one or more heating elements are connected to a positive terminal, and a negative terminal to receive electrical power from a battery to vaporize the E-liquid in a cylindrical E-liquid storage medium. The heating element base defines a first vaporizer E-liquid opening a second vaporizer E-liquid opening, a first vaporizer air intake, and a second vaporizer air intake. The vaporizer assembly includes a vaporizer base. In one embodiment, the vaporizer base defines a vaporizer base air intake to allow outside air to flow into the vaporizer assembly. In another embodiment, the vaporizer base defines a first vaporizer base air intake, and a second vaporizer base air intake to allow outside air to flow into the vaporizer assembly.

In certain embodiments, the E-liquid storage tank assembly and the vaporizer assembly are slidedly and rotatably connected through an E-liquid storage tank connector and a silicone gel sealing cover. When a user uses the electronic cigarette, the user pushes the E-liquid storage tank assembly down from an up position when the E-liquid storage tank assembly is determined to be in the up position, and rotates the vaporizer assembly using an E-liquid separation control handler from a first position to a second position when the E-liquid storage tank assembly is determined to be in the first position such that the first E-liquid storage tank base opening and the second E-liquid storage tank base opening coincide with the first vaporizer E-liquid opening and the second vaporizer E-liquid opening, respectively, and the E-liquid in the E-liquid storage tank flows into the cylindrical E-liquid storage medium to be vaporized by the one or more heating elements through E-liquid paths formed between the first E-liquid storage tank base opening and the first vaporizer E-liquid opening, and the second E-liquid storage tank base opening and the second vaporizer E-liquid opening, respectively.

In certain embodiments, when the user pushes down the E-liquid storage tank assembly to the down position, and rotates the vaporizer assembly from the first position to the second position to allow the E-liquid in the E-liquid storage tank to flow into the cylindrical E-liquid storage medium, turns on an electrical power supply and sucks from the mouthpiece, outside air flows through the first vaporizer base air intake and the second vaporizer base air intake into the two airflow paths, goes up to the cylindrical E-liquid storage medium and the one or more heating elements, and the vapor output, and finally exits from the mouthpiece.

In another aspect, the present disclosure relates to an electronic cigarette. In certain embodiments, the electronic cigarette includes an E-liquid separation mechanism. The E-liquid separation mechanism the E-liquid separation mechanism includes an E-liquid storage tank assembly, and a vaporizer assembly.

In certain embodiments, the E-liquid storage tank assembly includes an E-liquid storage tank storing E-liquid and an E-liquid storage tank base. The E-liquid storage tank base defines a first E-liquid storage tank base opening, and a second E-liquid storage tank base opening. The E-liquid storage tank stores the E-liquid between an external tube and an internal tube and the internal tube forms a vapor output.

The E-liquid storage tank assembly also has a mouthpiece positioned on a top end of the E-liquid storage tank and connected to the vapor output. The E-liquid storage tank assembly may include an E-liquid storage tank sealing ring to prevent the E-liquid from the E-liquid storage tank from leaking into the vaporizer assembly.

In certain embodiments, the vaporizer assembly includes one or more heating elements positioned on a heating element base. The one or more heating elements are connected to a positive terminal, and a negative terminal to receive electrical power from a battery to vaporize the E-liquid in a cylindrical E-liquid storage medium. The heating element base defines a first vaporizer E-liquid opening, a second vaporizer E-liquid opening, a first vaporizer air intake, and a second vaporizer air intake. The vaporizer assembly includes a vaporizer base. In one embodiment, the vaporizer base defines a vaporizer base air intake to allow outside air to flow into the vaporizer assembly. In another embodiment, the vaporizer base defines a first vaporizer base air intake, and a second vaporizer base air intake to allow outside air to flow into the vaporizer assembly.

In certain embodiments, the E-liquid storage tank assembly and the vaporizer assembly are slidedly and rotatably connected through an E-liquid storage tank connector and a silicone gel sealing cover. When a user uses the electronic cigarette, the user pushes the E-liquid storage tank assembly down from an up position when the E-liquid storage tank assembly is determined to be in the up position, and rotates the vaporizer assembly using an E-liquid separation control handler from a first position to a second position when the E-liquid storage tank assembly is determined to be in the first position such that the first E-liquid storage tank base opening and the second E-liquid storage tank base opening coincide with the first vaporizer E-liquid opening and the second vaporizer E-liquid opening, respectively, and the E-liquid in the E-liquid storage tank flows into the cylindrical E-liquid storage medium to be vaporized by the one or more heating elements through E-liquid paths formed between the first E-liquid storage tank base opening and the first vaporizer E-liquid opening, and the second E-liquid storage tank base opening and the second vaporizer E-liquid opening, respectively.

In certain embodiments, when the user pushes down the E-liquid storage tank assembly to the down position, and rotates the vaporizer assembly from the first position to the second position to allow the E-liquid in the E-liquid storage tank to flow into the cylindrical E-liquid storage medium, turns on an electrical power supply and sucks from the mouthpiece, outside air flows through the first vaporizer base air intake and the second vaporizer base air intake into the two airflow paths, goes up to the cylindrical E-liquid storage medium and the one or more heating elements, and the vapor output, and finally exits from the mouthpiece.

In yet another aspect, the present disclosure relates to a method of using an electronic cigarette having an E-liquid separation mechanism. In certain embodiments, the method may include: determining, by a user, whether an E-liquid storage tank assembly is in an up position, pushing down, by the user, the E-liquid storage tank assembly against a vaporizer assembly from the up position to a down position, when the E-liquid storage tank assembly is determined to be in the up position. The method may also include: determining, by the user, whether the E-liquid storage tank assembly is in a first position, and rotating, by the user, the E-liquid storage tank assembly against the vaporizer assembly from the first position to a second position, when the E-liquid storage tank assembly is determined to be in the first position. When the E-liquid storage tank assembly is in the second position, a first E-liquid storage tank base opening and a second E-liquid storage tank base opening defined on a vaporizer base of the vaporizer assembly coincide with a first vaporizer E-liquid opening and a second vaporizer E-liquid opening defined on a heating element base, respectively, and E-liquid filled in an E-liquid storage tank flows into a cylindrical E-liquid storage medium to be vaporized by one or more heating elements through E-liquid paths formed between the first E-liquid storage tank base opening and the first vaporizer E-liquid opening, and the second E-liquid storage tank base opening and the second vaporizer E-liquid opening, respectively.

In certain embodiments, the method also includes: turning on, by the user, an electrical power supply to provide electrical power to the one or more heating elements of the vaporizer assembly to vaporize the E-liquid flowed to the cylindrical E-liquid storage medium when the E-liquid storage tank assembly is in the second position, and sucking, by the user, E-liquid vapor from the vaporizer assembly through a mouthpiece. Air outside of the electronic cigarette enters the vaporizer assembly through a first vaporizer air intake and a second vaporizer air intake to be vaporized by the vaporizer assembly, and the vapor formed by the vaporizer assembly exits through a vapor output and the mouthpiece.

In certain embodiments, when the user finish using the electronic cigarette, the method also includes: determining, by the user, whether the E-liquid storage tank assembly is in the second position, rotating, by the user, the E-liquid storage tank assembly against the vaporizer assembly from the second position to the first position, when the E-liquid storage tank assembly is determined to be in the second position, and pulling up, by the user, the E-liquid storage tank assembly against the vaporizer assembly from the down position to the up position to terminate the E-liquid flow and separate the E-liquid in the E-liquid storage tank from the cylindrical E-liquid storage medium.

These and other aspects of the present disclosure will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and, together with the written description, serve to explain the principles of the disclosure. Wherever possible, the same reference numbers are used throughout the drawings to refer to the same or like elements of an embodiment. The drawings do not limit the present disclosure to the specific embodiments disclosed and described herein. The drawings are not necessarily to scale, emphasis instead being placed upon clearly illustrating the principles of the disclosure, and wherein.

DETAILED DESCRIPTION

Figure 1:
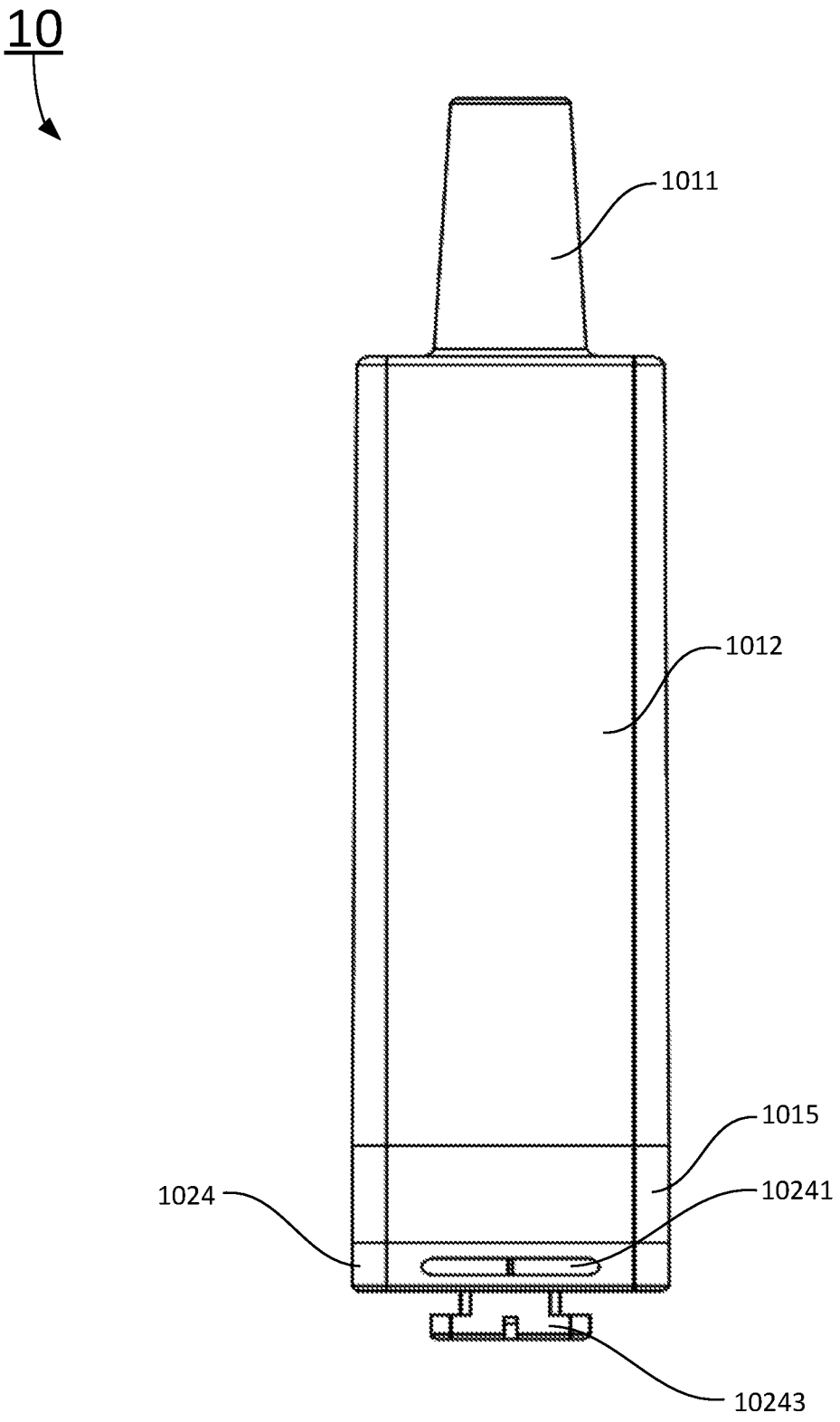
FIG. 1 is an external view of an exemplary electronic cigarette having an E-liquid separation mechanism according to certain embodiments of the present disclosure.

The present disclosure will now be described more fully hereinafter with reference to the accompanying drawings, in which exemplary embodiments of the disclosure are shown. This disclosure may, however, be embodied in many different forms and should not be construed as limited to the embodiments set forth herein. Rather, these embodiments are provided so that this disclosure will be thorough and complete, and will fully convey the scope of the disclosure to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximates, meaning that the term "around", "about" or "approximately" can be inferred if not expressly stated.

Many specific details are provided in the following descriptions to make the present disclosure be fully understood, but the present disclosure may also be implemented by using other manners different from those described herein, so that the present disclosure is not limited by the specific embodiments disclosed in the following.

The description will be made as to the embodiments of the present disclosure in conjunction with the accompanying drawings FIGS. 1 through 9.

Figure 2:
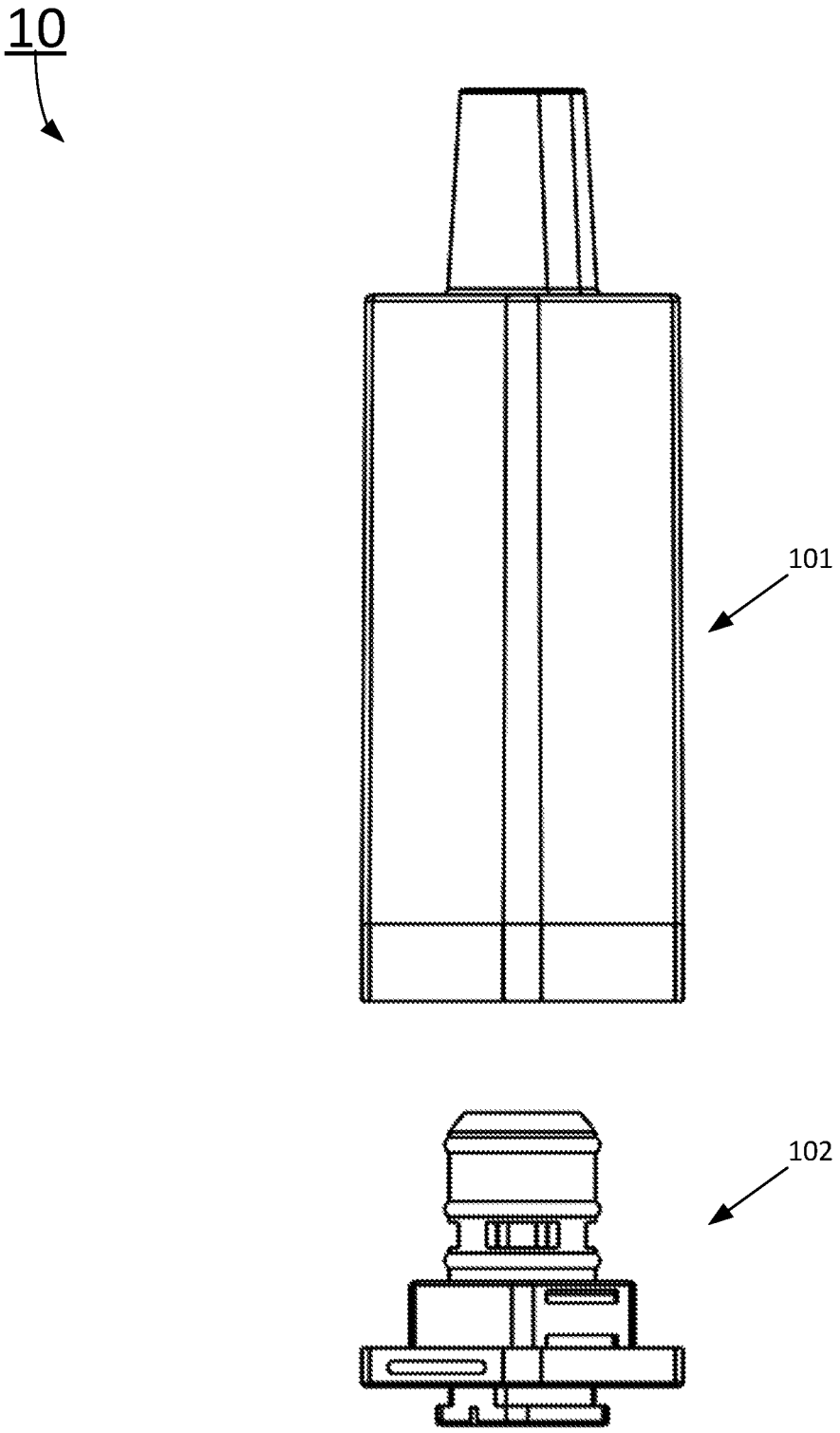
FIG. 2 is an exploded perspective view of two major components of the electronic cigarette having the E-liquid separation mechanism according to certain embodiments of the present disclosure.

In one aspect, the present disclosure relates to an E-liquid separation mechanism for an electronic cigarette 10. Referring now to FIG. 1, an external view of an exemplary electronic cigarette 10 having an E-liquid separation mechanism is shown according to certain embodiments of the present disclosure. In certain embodiments, the E-liquid separation mechanism includes an E-liquid storage tank assembly 101, and a vaporizer assembly 102, as shown in FIG. 2.

Figure 3:
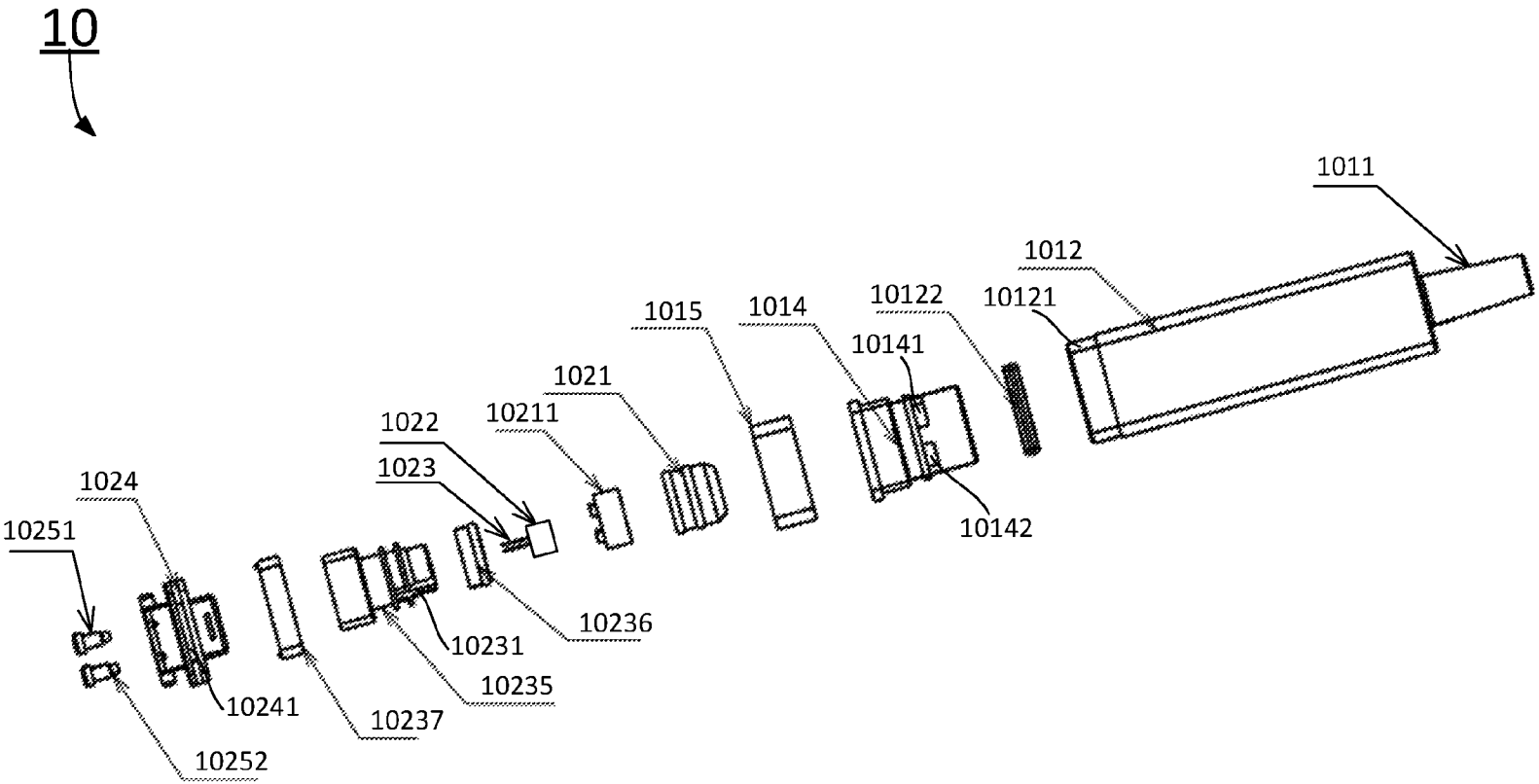
FIG. 3 is an exploded side view of the electronic cigarette having the E-liquid separation mechanism according to certain embodiments of the present disclosure.
Figure 4:
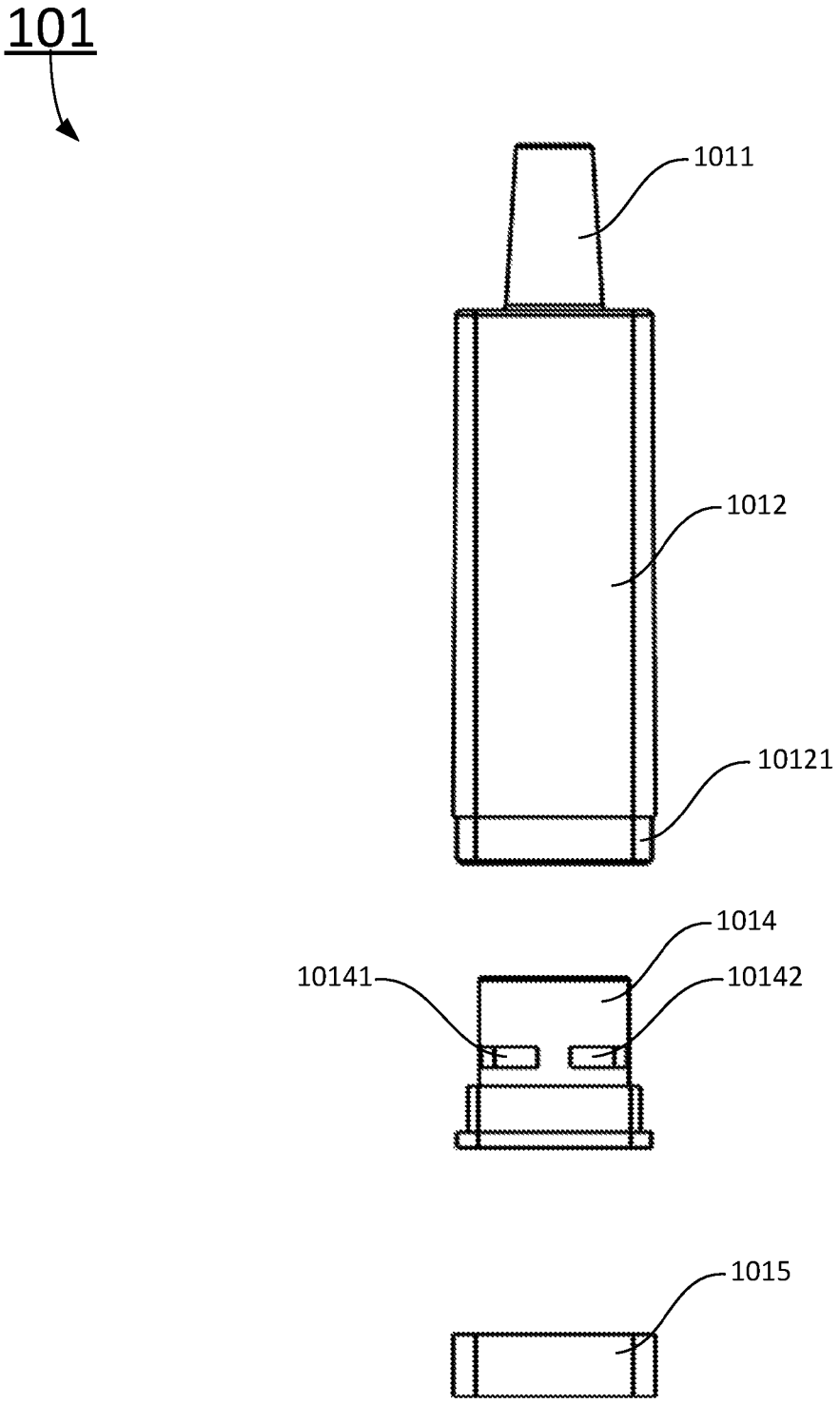
FIG. 4 is an exploded side view of an E-liquid storage tank assembly of the electronic cigarette having the E-liquid separation mechanism according to certain embodiments of the present disclosure.
Figure 6A:
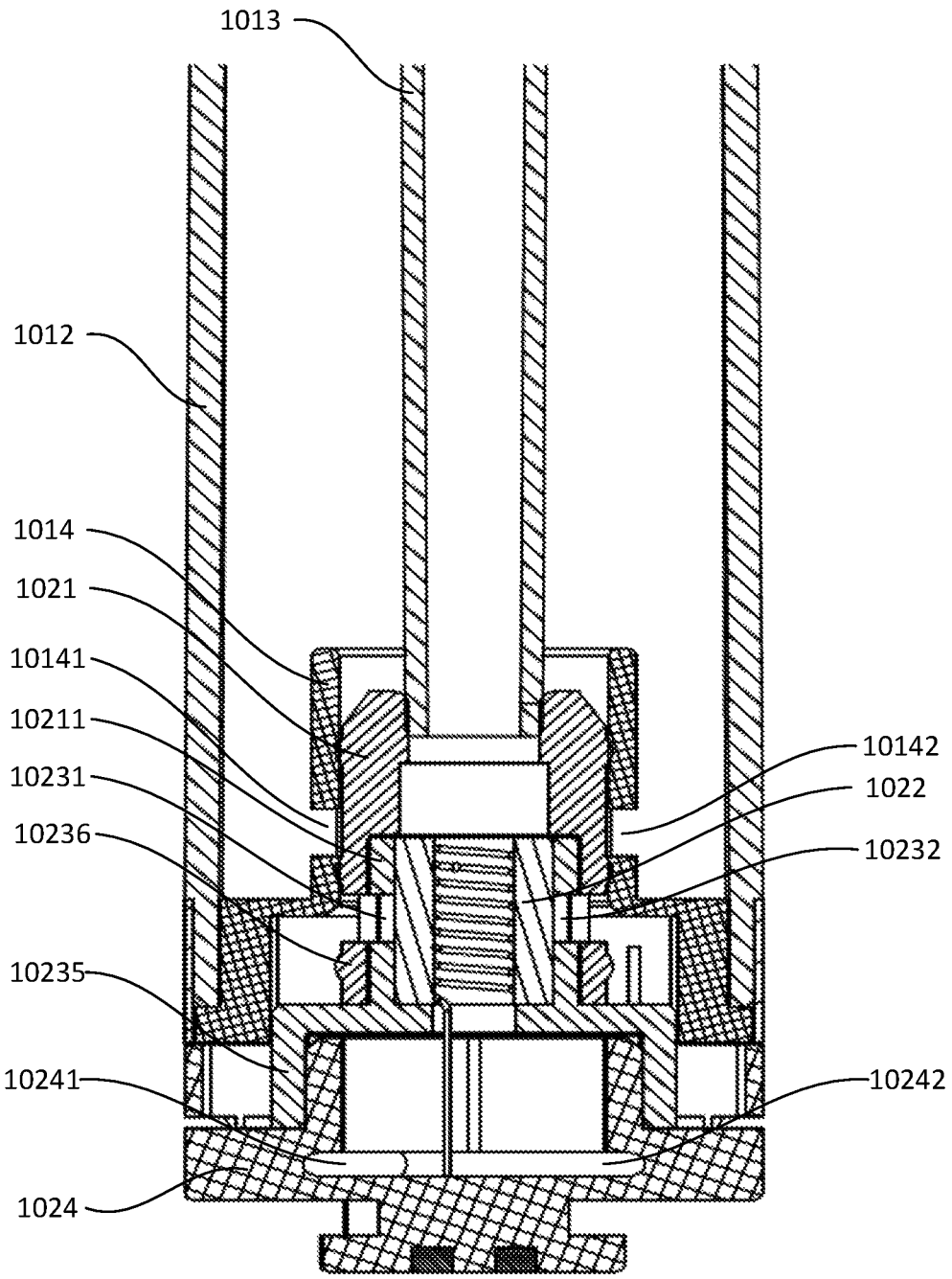
FIG. 6A is a detailed cross-sectional view of the E-liquid storage tank assembly of the electronic cigarette when the E-liquid storage tank assembly is in an up position and E-liquid supply paths are blocked.

Referring now to FIG. 3, an exploded side view of the electronic cigarette having the E-liquid separation mechanism is shown according to certain embodiments of the present disclosure. In certain embodiments, as also shown in FIG. 4, the E-liquid storage tank assembly 101 includes an E-liquid storage tank 1012 storing E-liquid and an E-liquid storage tank base 10121. The E-liquid storage tank base 10121 defines a first E-liquid storage tank base opening 10141, and a second E-liquid storage tank base opening 10142. The E-liquid storage tank 1012 stores the E-liquid between an external tube and an internal tube as shown in FIG. 6A. The internal tube forms a vapor output 1013. The E-liquid storage tank assembly 101 also has a mouthpiece 1011 positioned on a top end of the E-liquid storage tank 1012 and connected to the vapor output 1013. The E-liquid storage tank assembly 101 may include an E-liquid storage tank sealing ring 10122 to prevent the E-liquid from the E-liquid storage tank 1012 from leaking into the vaporizer assembly 102. The E-liquid storage tank assembly 101 may also include a decoration ring 1015 to cover the E-liquid storage tank base 10121.

Figure 5:
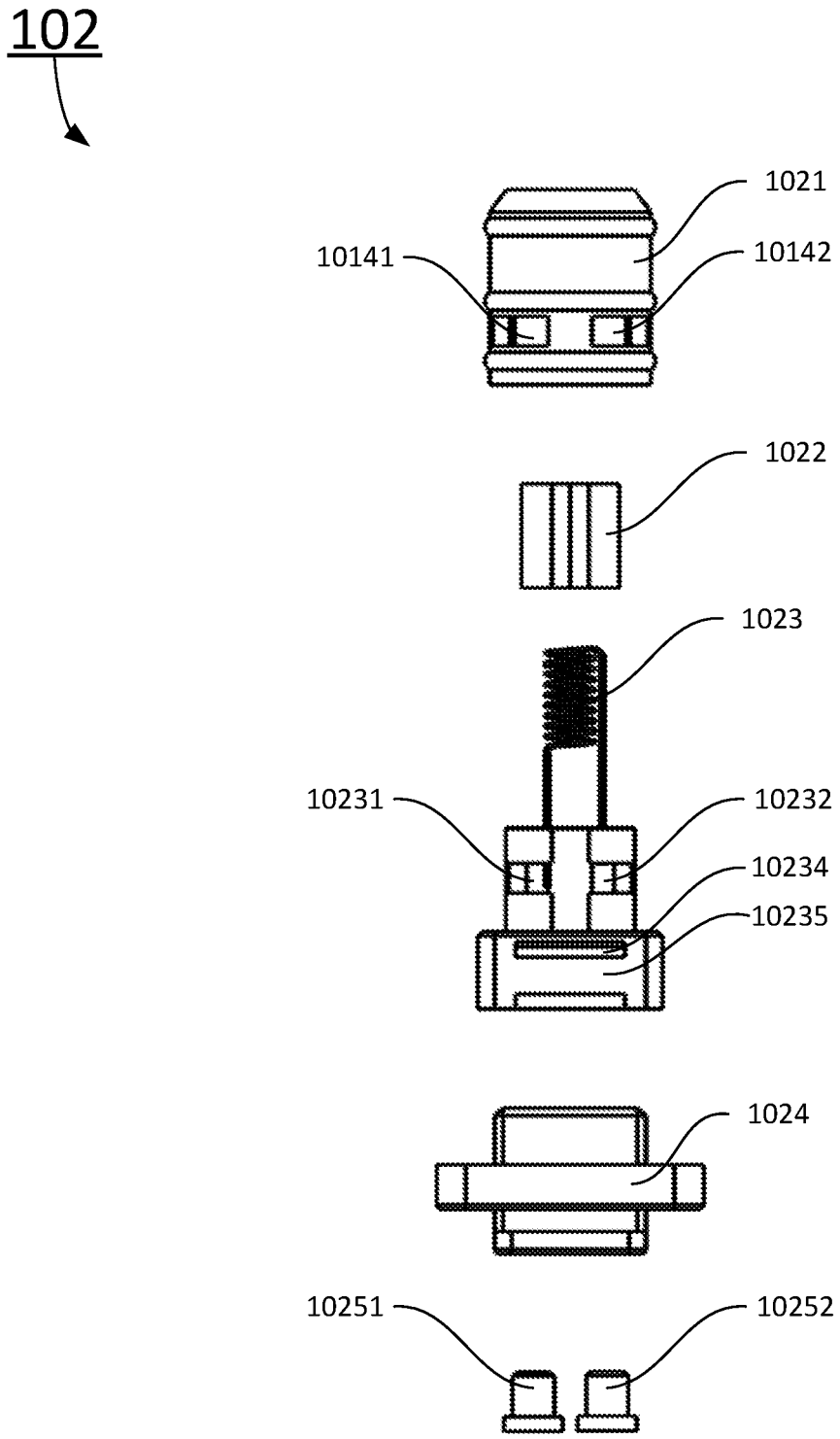
FIG. 5 is an exploded side view of a vaporizer assembly of the electronic cigarette having the E-liquid separation mechanism according to certain embodiments of the present disclosure.
Figure 6B:
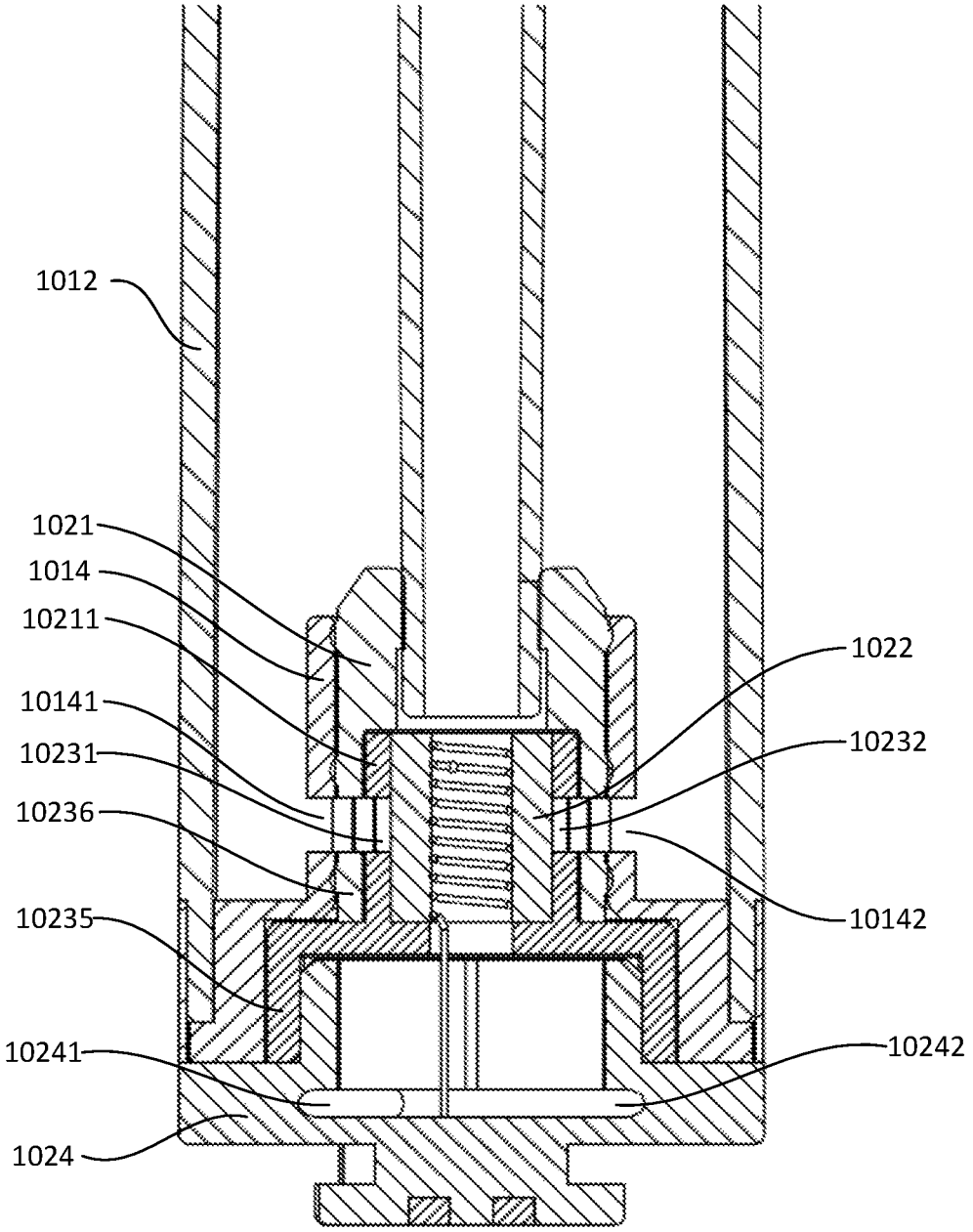
FIG. 6B is a detailed cross-sectional view of the E-liquid storage tank assembly of the electronic cigarette when the E-liquid storage tank assembly is in a down position, and the E-liquid storage tank assembly is in a second position and E-liquid supply paths are opened according to certain embodiments of the present disclosure.

In certain embodiments, as shown in FIG. 5, the vaporizer assembly 102 includes one or more heating elements 1023 positioned on a heating element base 10235. The one or more heating elements 1023 are connected to a positive terminal 10251, and a negative terminal 10252 to receive electrical power from a battery to vaporize the E-liquid in a cylindrical E-liquid storage medium 1022. The heating element base 10235 defines a first vaporizer E-liquid opening 10231 a second vaporizer E-liquid opening 10232, a first vaporizer air intake 10233 (not shown in FIG. 5), and a second vaporizer air intake 10234. The vaporizer assembly 102 includes a vaporizer base 1024. In one embodiment, the vaporizer base 1024 defines a vaporizer base air intake to allow outside air to flow into the vaporizer assembly. In another embodiment, the vaporizer base 1024 defines a first vaporizer base air intake 10241 (as shown in FIGS. 6A and 6B), and a second vaporizer base air intake 10242 (as shown in FIGS. 6A and 6B) to allow outside air to flow into the vaporizer assembly 102.

In certain embodiments, the vaporizer assembly 102 may include a heating element sealing ring 10236 to prevent the E-liquid in the cylindrical E-liquid storage medium from leaking out of the vaporizer assembly 102. The vaporizer assembly 102 may also include a vaporizer cover 10211 to cover the cylindrical E-liquid storage medium 1022.

In one embodiment, the E-liquid storage tank assembly 101 is in a square tube shape as shown in FIGS. 1-5. In another embodiment, the E-liquid storage tank assembly 101 may be in a round tube shape as shown in FIGS. 6-7. In yet another embodiment, the E-liquid storage tank assembly 101 may be in an oval tube shape.

In certain embodiments, the E-liquid storage tank assembly 101 and the vaporizer assembly 102 are slidedly and rotatably connected through an E-liquid storage tank connector 1014 and a silicone gel sealing cover 1021. When the electronic cigarette 10 is shipped out of factory, or it is not in use, the E-liquid storage tank assembly 101 is in an up position and E-liquid supply path is blocked as shown in FIG. 6A. When a user wants to use the electronic cigarette 10, the user pushes the E-liquid storage tank assembly 101 down from the up position to a down position, and rotates the vaporizer assembly 102 using an E-liquid separation control handler 10237 from a first position to a second position when the E-liquid storage tank assembly 101 is determined to be in the first position such that the first E-liquid storage tank base opening 10141 and the second E-liquid storage tank base opening 10142 coincide with the first vaporizer E-liquid opening 10231 and the second vaporizer E-liquid opening 10232, respectively, allowing the E-liquid in the E-liquid storage tank 1012 to flow into the cylindrical E-liquid storage medium 1022 to be vaporized by the one or more heating elements 1023 through E-liquid paths formed between the first E-liquid storage tank base opening 10141 and the first vaporizer E-liquid opening 10231, and the second E-liquid storage tank base opening 10142 and the second vaporizer E-liquid opening 10232, respectively, as shown in FIG. 6B.

Figure 7A:
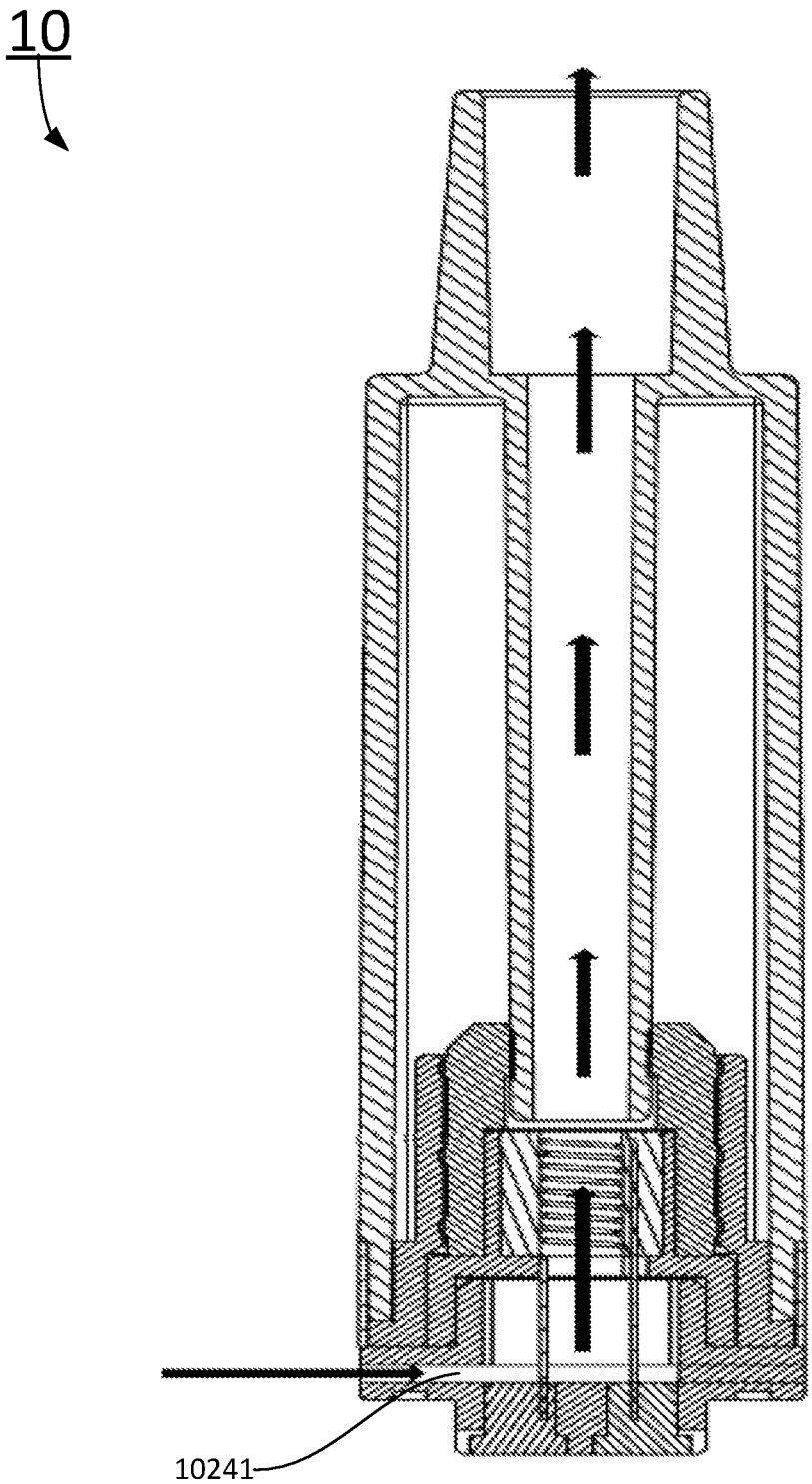
FIG. 7A is a detailed cross-sectional view of the electronic cigarette showing air flow from a vaporizer base air intake.
Figure 7B:
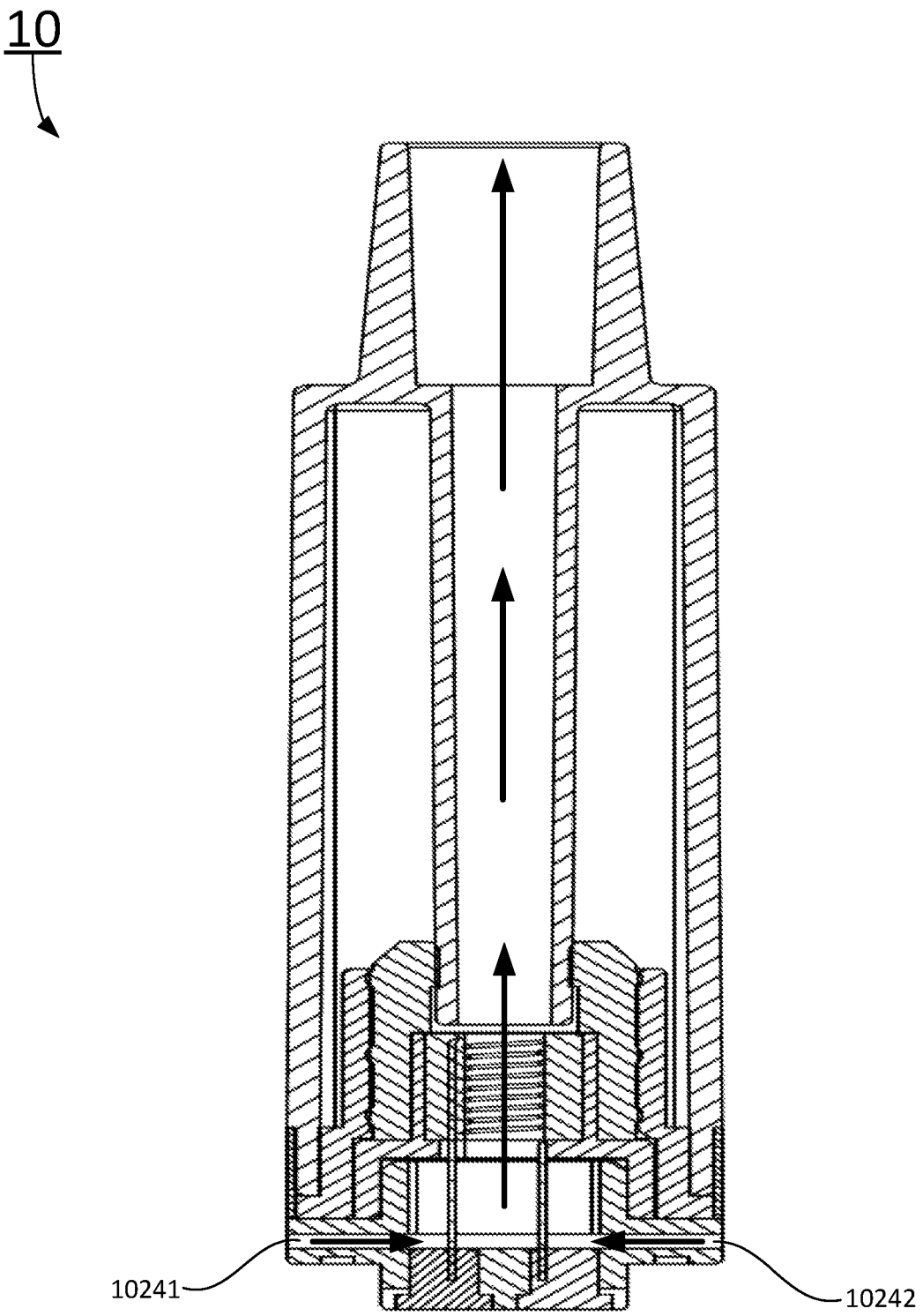
FIG. 7B is a detailed cross-sectional view of the electronic cigarette showing air flow from a first vaporizer base air intake and a second vaporizer base air intake according to certain embodiments of the present disclosure.

In certain embodiments, when the user pushes down the E-liquid storage tank assembly 101 to the down position, and rotates the vaporizer assembly 102 from the first position to the second position to allow the E-liquid in the E-liquid storage tank 1012 to flow into the cylindrical E-liquid storage medium 1022. In one embodiment, the user turns on an electrical power supply and sucks from the mouthpiece 1011, outside air flows through the first vaporizer base air intake 10241 as shown in FIG. 7A, goes up to the cylindrical E-liquid storage medium 1022 and the heating elements 1023, and the vapor output 1013, and finally exits from the mouthpiece 1011. In another embodiment, outside air flows through the first vaporizer base air intake 10241 and the second vaporizer base air intake 10242 into two separate airflow paths as shown in FIG. 7B, goes up to the cylindrical E-liquid storage medium 1022 and the heating elements 1023, and the vapor output 1013, and finally exits from the mouthpiece 1011.

Figure 8B:
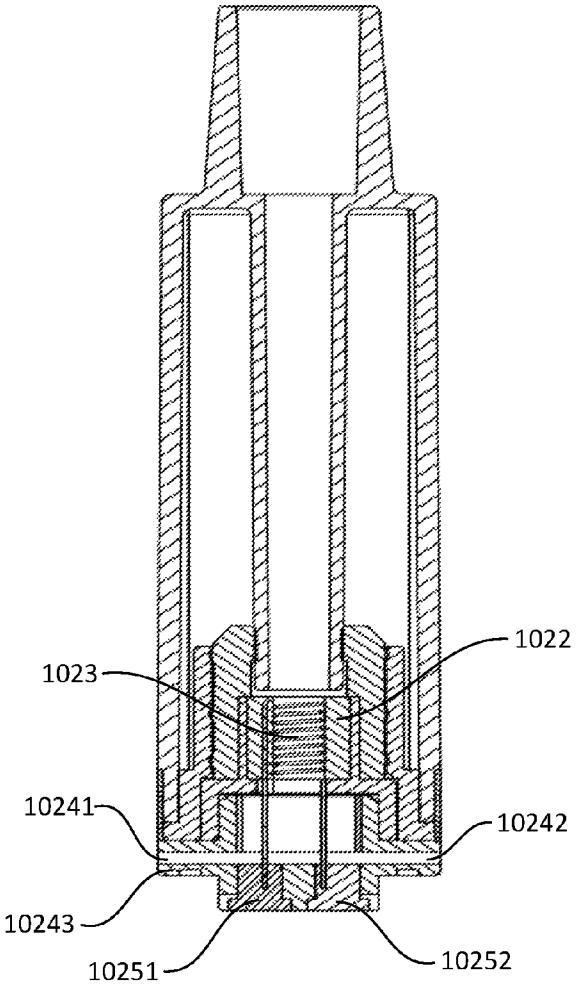
FIG. 8B is a detailed cross-sectional view of the electronic cigarette showing a positive terminal and a negative terminal electrically coupled to a heating element according to certain embodiments of the present disclosure.
Figure 8A:
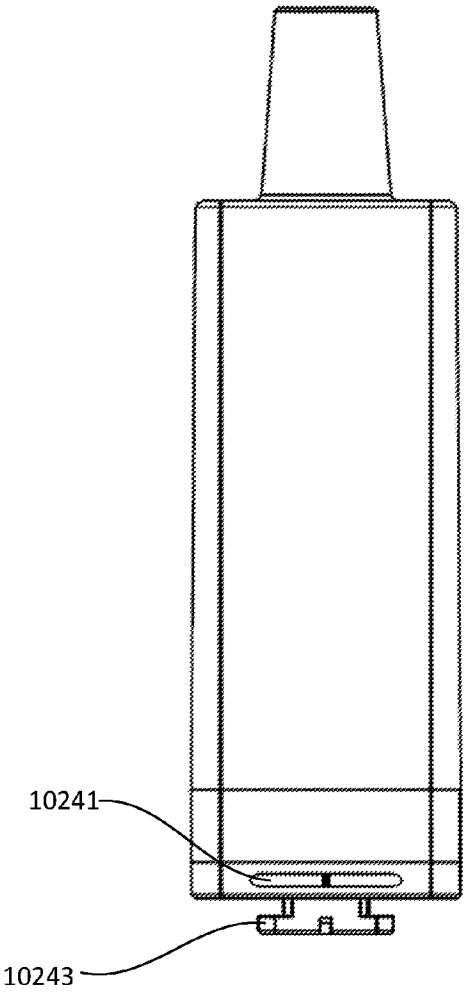
FIG. 8A is an external side view of the electronic cigarette showing the first vaporizer base air intake, the second vaporizer base air intake and a battery connector.

FIG. 8A is an external side view of the electronic cigarette 10 showing the first vaporizer base air intake, the second vaporizer base air intake and a battery connector 10243. In one embodiment, the battery connector 10243 between the battery and the vaporizer base 1024 may be a T-shaped groove connector as shown in FIG. 8A. In another embodiment, the battery connector 10243 between the battery and the vaporizer base 1024 may be a dovetail shaped slot connector (not shown in FIG. 8A). In other embodiments, the battery connector 10243 may include a magnetic attachment connector, a threaded connector, and/or a multi-threaded connector (not shown in FIG. 8A).

In certain embodiments, each of the one or more heating elements 1023 has a positive terminal electrically coupled to a positive terminal of the battery through the positive terminal 10251 of the vaporizer base 1024, and a negative terminal electrically coupled to a negative terminal of the battery through the negative terminal 10252 of the vaporizer base 1024, as shown in FIG. 8B. In one embodiment, the one or more heating elements 1023 may be connected in parallel. In another embodiment, the one or more heating elements 1023 may be connected in serial. In yet another embodiment, the one or more heating elements 1023 may be connected in combination of parallel and serial connections.

In certain embodiments, the one or more heating elements 1023 may include: one or more grid shaped heating elements, one or more mesh shaped heating elements, one or more net shaped heating elements, one or more spiral heating elements, and any combination of these heating elements.

In certain embodiments, the cylindrical E-liquid storage medium 1022 may include: cotton fibers, polypropylene fibers, terylene fibers, nylon fibers, and porous ceramic materials.

In certain embodiments, the E-liquid separation control handler 10237 is positioned on the heating element base 10235 to operate the E-liquid separation mechanism when the E-liquid storage tank assembly 101 is in the down position. When the E-liquid storage tank assembly 101 is in the up position, the E-liquid flow from the E-liquid storage tank 1012 to the cylindrical E-liquid storage medium 1022 is always turned off. When the user rotates the heating element base 10235 from the first position to the second position, the E-liquid flow from the E-liquid storage tank 1012 to the cylindrical E-liquid storage medium 1022 is turned on. When the user rotates the heating element base 10235 from the second position to the first position, the E-liquid flow from the E-liquid storage tank 1012 to the cylindrical E-liquid storage medium 1022 is turned off.

In another aspect, the present disclosure relates to an electronic cigarette 10. In certain embodiments, the electronic cigarette 10 includes an E-liquid separation mechanism. The E-liquid separation mechanism the E-liquid separation mechanism includes an E-liquid storage tank assembly 101, and a vaporizer assembly 102.

In certain embodiments, the E-liquid storage tank assembly 101 includes an E-liquid storage tank 1012 storing E-liquid and an E-liquid storage tank base 10121. The E-liquid storage tank base 10121 defines a first E-liquid storage tank base opening 10141, and a second E-liquid storage tank base opening 10142. The E-liquid storage tank 1012 stores the E-liquid between an external tube and an internal tube and the internal tube forms a vapor output 1013. The E-liquid storage tank assembly 101 also has a mouthpiece 1011 positioned on a top end of the E-liquid storage tank 1012 and connected to the vapor output 1013. The E-liquid storage tank assembly 101 may include an E-liquid storage tank sealing ring 10122 to prevent the E-liquid from the E-liquid storage tank 1012 from leaking into the vaporizer assembly 102.

In certain embodiments, the vaporizer assembly 102 includes one or more heating elements 1023 positioned on a heating element base 10235. The one or more heating elements 1023 are connected to a positive terminal 10251, and a negative terminal 10252 to receive electrical power from a battery to vaporize the E-liquid in a cylindrical E-liquid storage medium 1022. The heating element base 10235 defines a first vaporizer E-liquid opening 10231 a second vaporizer E-liquid opening 10232, a first vaporizer air intake 10233, and a second vaporizer air intake 10234. The vaporizer assembly 102 includes a vaporizer base 1024. In one embodiment, the vaporizer base 1024 defines a vaporizer base air intake to allow outside air to flow into the vaporizer assembly. In another embodiment, the vaporizer base 1024 defines a first vaporizer base air intake 10241, and a second vaporizer base air intake 10242 to allow outside air to flow into the vaporizer assembly 102.

In certain embodiments, the vaporizer assembly 102 may include a heating element sealing ring 10236 to prevent the E-liquid in the cylindrical E-liquid storage medium from leaking out of the vaporizer assembly 102. The vaporizer assembly 102 may also include a vaporizer cover 10211 to cover the cylindrical E-liquid storage medium 1022.

In certain embodiments, the E-liquid storage tank assembly 101 and the vaporizer assembly 102 are slidedly and rotatably connected through an E-liquid storage tank connector 1014 and a silicone gel sealing cover 1021. When a user uses the electronic cigarette 10, the user pushes the E-liquid storage tank assembly 101 down from an up position when the E-liquid storage tank assembly 101 is determined to be in the up position, and rotates the vaporizer assembly 102 using an E-liquid separation control handler 10237 from a first position to a second position when the E-liquid storage tank assembly 101 is determined to be in the first position such that the first E-liquid storage tank base opening 10141 and the second E-liquid storage tank base opening 10142 coincide with the first vaporizer E-liquid opening 10231 and the second vaporizer E-liquid opening 10232, respectively, and the E-liquid in the E-liquid storage tank 1012 flows into a cylindrical E-liquid storage medium 1022 to be vaporized by the one or more heating elements 1023 through E-liquid paths formed between the first E-liquid storage tank base opening 10141 and the first vaporizer E-liquid opening 10231, and the second E-liquid storage tank base opening 10142 and the second vaporizer E-liquid opening 10232, respectively.

In certain embodiments, when the user pushes down the E-liquid storage tank assembly 101 to the down position, and rotates the vaporizer assembly 102 from the first position to the second position to allow the E-liquid in the E-liquid storage tank 1012 to flow into the cylindrical E-liquid storage medium 1022, turns on an electrical power supply and sucks from the mouthpiece 1011, outside air flows through the first vaporizer base air intake 10241 and the second vaporizer base air intake 10242 into the two airflow paths, goes up to the cylindrical E-liquid storage medium 1022 and the heating elements 1023, and the vapor output 1013, and finally exits from the mouthpiece 1011.

In one embodiment, the battery connector 10243 between the battery and the vaporizer base 1024 may be a T-shaped groove connector. In another embodiment, the battery connector 10243 between the battery and the vaporizer base 1024 may be a dovetail shaped slot connector. In other embodiments, the battery connector 10243 may include a magnetic attachment connector, a threaded connector, and/or a multi-threaded connector.

In certain embodiments, the E-liquid separation control handler 10237 is positioned on the heating element base 10235 to operate the E-liquid separation mechanism when the E-liquid storage tank assembly 101 is in the down position. When the E-liquid storage tank assembly 101 is in the up position, the E-liquid flow from the E-liquid storage tank 1012 to the cylindrical E-liquid storage medium 1022 is always turned off. When the user rotates the heating element base 10235 from the first position to the second position, the E-liquid flow from the E-liquid storage tank 1012 to the cylindrical E-liquid storage medium 1022 is turned on. When the user rotates the heating element base 10235 from the second position to the first position, the E-liquid flow from the E-liquid storage tank 1012 to the cylindrical E-liquid storage medium 1022 is turned off.

In certain embodiments, each of the one or more heating elements 1023 has a positive terminal electrically coupled to a positive terminal of the battery through the positive terminal 10251 of the vaporizer base 1024, and a negative terminal electrically coupled to a negative terminal of the battery through the negative terminal 10252 of the vaporizer base 1024. In one embodiment, the one or more heating elements 1023 may be connected in parallel. In another embodiment, the one or more heating elements 1023 may be connected in serial. In yet another embodiment, the one or more heating elements 1023 may be connected in combination of parallel and serial.

In certain embodiments, the one or more heating elements 1023 may include: one or more grid shaped heating elements, one or more mesh shaped heating elements, one or more net shaped heating elements, one or more spiral heating elements, and any combination of these heating elements.

In certain embodiments, the cylindrical E-liquid storage medium 1022 may include: cotton fibers, polypropylene fibers, terylene fibers, nylon fibers, and porous ceramic materials.

Figure 9:
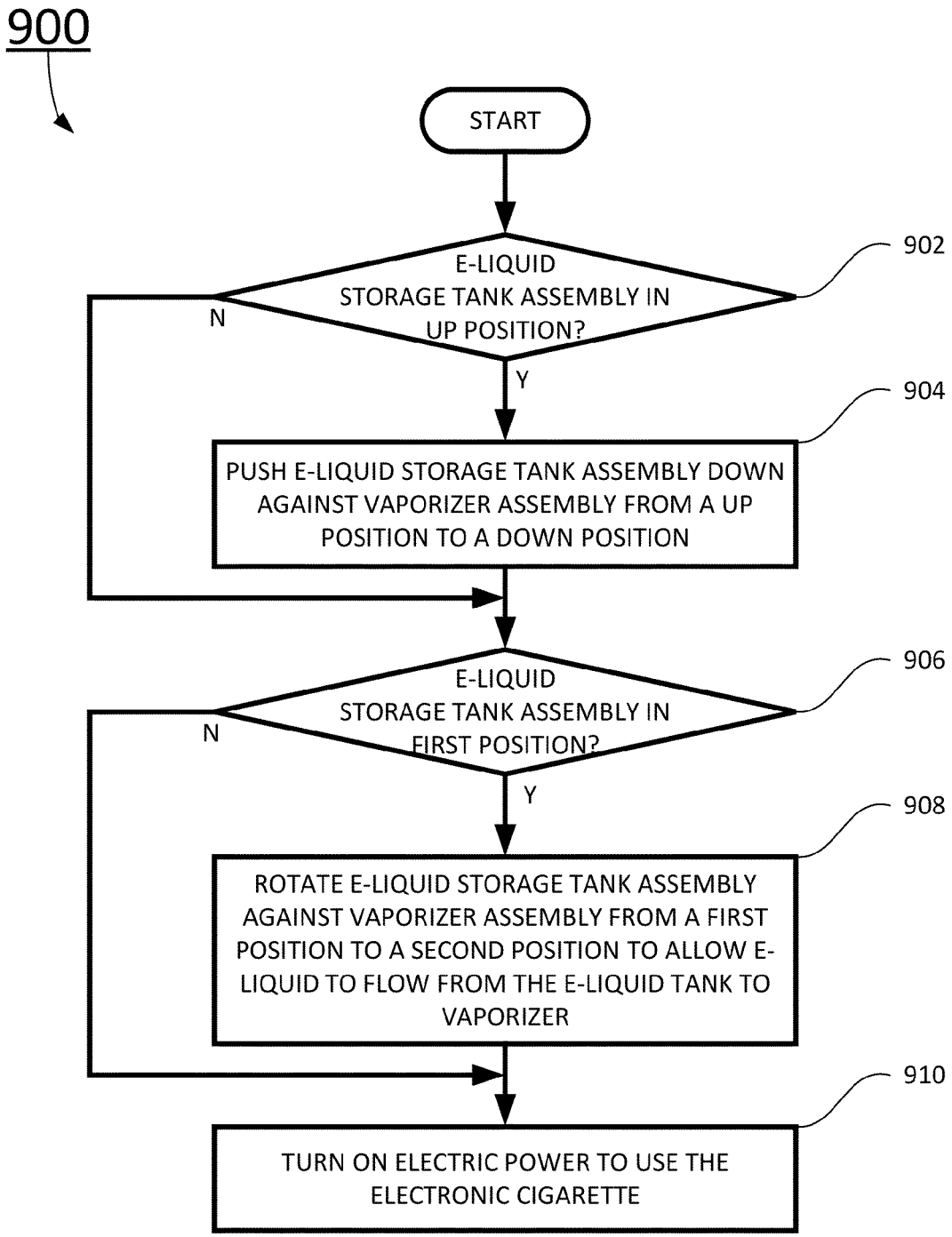
FIG. 9 is a flow chart showing a method of using the electronic cigarette having the E-liquid separation mechanism according to certain embodiments of the present disclosure.

In yet another aspect, the present disclosure relates to a method of using an electronic cigarette 10 having an E-liquid separation mechanism as shown in FIG. 9.

At query block 902, the user determines whether an E-liquid storage tank assembly 101 is in an up position. When the electronic cigarette 10 is shipped out of factory, or it is not in use, the E-liquid storage tank assembly 101 is usually in the up position so that the E-liquid from an E-liquid storage tank 1012 is separated from the vaporizer assembly 102 and E-liquid supply path is blocked. When the E-liquid storage tank assembly 101 is in the up position, the method proceeds to block 904. Otherwise, the method skips block 904 and proceeds to block 906.

At block 904, the user pushes down the E-liquid storage tank assembly 101 against a vaporizer assembly 102 from the up position to a down position.

At query block 906, the user determines whether the E-liquid storage tank assembly 101 is in a first position. When the electronic cigarette 10 is not in use, the E-liquid storage tank assembly 101 is usually placed in the first position so that the E-liquid from the E-liquid storage tank 1012 is separated from the vaporizer assembly 102 and the E-liquid supply path is blocked. When the E-liquid storage tank assembly 101 is in the first position, the method proceeds to block 908. Otherwise, the method skips block 908 and proceeds to block 910.

At block 908, the user rotates the E-liquid storage tank assembly 101 against the vaporizer assembly 102 from the first position to a second position. When the E-liquid storage tank assembly 101 is in the second position, a first E-liquid storage tank base opening 10141 and a second E-liquid storage tank base opening 10142 defined on a vaporizer base 1024 of the vaporizer assembly 102 coincide with a first vaporizer E-liquid opening 10231 and the second vaporizer E-liquid opening 10232 defined on a heating element base 10235, respectively, allowing E-liquid filled in the E-liquid storage tank 1012 to flow into a cylindrical E-liquid storage medium 1022 to be vaporized by one or more heating elements 1023 through E-liquid paths formed between the first E-liquid storage tank base opening 10141 and the first vaporizer E-liquid opening 10231, and the second E-liquid storage tank base opening 10142 and the second vaporizer E-liquid opening 10232, respectively.

At block 910, the user turn an electrical power supply to provide electrical power to the one or more heating elements 1023 of the vaporizer assembly 102 to vaporize the E-liquid flowed to the cylindrical E-liquid storage medium 1022 when the E-liquid storage tank assembly 101 is in the second position, and sucks E-liquid vapor from the vaporizer assembly 102 through a mouthpiece 1011. Air outside of the electronic cigarette 10 enters the vaporizer assembly 102 through a first vaporizer air intake 10233 and a second vaporizer air intake 10234 to be vaporized by the vaporizer assembly 102, and the vapor formed by the vaporizer assembly 102 exits through a vapor output 1013 and the mouthpiece 1011.

In certain embodiments, when the user finish using the electronic cigarette 10, the method also includes: determining, by the user, whether the E-liquid storage tank assembly 101 is in the second position, rotating, by the user, the E-liquid storage tank assembly 101 against the vaporizer assembly 102 from the second position to the first position, when the E-liquid storage tank assembly 101 is determined to be in the second position, and pulling up, by the user, the E-liquid storage tank assembly 101 against the vaporizer assembly 102 from the down position to the up position to terminate the E-liquid flow and separate the E-liquid in the E-liquid storage tank 1012 from the cylindrical E-liquid storage medium 1022.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to activate others skilled in the art to utilize the disclosure and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims, the foregoing description and the exemplary embodiments described therein, and accompanying drawings.

What is claimed is:

1. An E-liquid separation mechanism for an electronic cigarette, comprising:

an E-liquid storage tank assembly having an E-liquid storage tank storing E-liquid and an E-liquid storage tank base, wherein the E-liquid storage tank base defines a first E-liquid storage tank base opening, and a second E-liquid storage tank base opening; and a vaporizer assembly having a heating element base having one or more heating elements, wherein the heating element base defines a first vaporizer E-liquid opening and a second vaporizer E-liquid opening, wherein the E-liquid storage tank assembly and the vaporizer assembly are slidedly and rotatably connected through an E-liquid storage tank connector and a silicone gel sealing cover, and when a user uses the electronic cigarette, the user pushes the E-liquid storage tank assembly down from an up position when the E-liquid storage tank assembly is determined to be in the up position, and rotates the vaporizer assembly using an E-liquid separation control handler from a first position to a second position when the E-liquid storage tank assembly is determined to be in the first position such that the first E-liquid storage tank base opening and the second E-liquid storage tank base opening coincide with the first vaporizer E-liquid opening and the second vaporizer E-liquid opening, respectively, and the E-liquid in the E-liquid storage tank flows into a cylindrical E-liquid storage medium to be vaporized by the one or more heating elements through E-liquid paths formed between the first E-liquid storage tank base opening and the first vaporizer E-liquid opening, and the second E-liquid storage tank base opening and the second vaporizer E-liquid opening, respectively.

2. The E-liquid separation mechanism of claim 1, wherein the E-liquid storage tank assembly further comprises:

the E-liquid storage tank storing the E-liquid between an external tube and an internal tube, wherein the internal tube forms a vapor output;

a mouthpiece positioned on a top end of the E-liquid storage tank and connected to the vapor output; and an E-liquid storage tank sealing ring to prevent the E-liquid from the E-liquid storage tank from leaking into the vaporizer assembly.

3. The E-liquid separation mechanism of claim 1, wherein the vaporizer assembly further comprises:

a vaporizer cover to cover the cylindrical E-liquid storage medium;

the one or more heating elements connected to a positive terminal, and a negative terminal to receive electrical power from a battery to vaporize the E-liquid in the cylindrical E-liquid storage medium, wherein the one or more heating elements are positioned on the heating element base having a first vaporizer air intake, and a second vaporizer air intake;

a heating element sealing ring to prevent the E-liquid in the cylindrical E-liquid storage medium from leaking out of the vaporizer assembly; and a vaporizer base defining a first vaporizer base air intake and a second vaporizer base air intake to allow outside air to flow into the vaporizer assembly.

4. The E-liquid separation mechanism of claim 3, wherein when the user pushes down the E-liquid storage tank assembly to the down position, and rotates the vaporizer assembly from the first position to the second position to allow the E-liquid in the E-liquid storage tank to flow into the cylindrical E-liquid storage medium, turns on an electrical power supply and sucks from the mouthpiece, outside air flows through the first vaporizer base air intake and the second vaporizer base air intake into the two airflow paths, goes up to the cylindrical E-liquid storage medium and the one or more heating elements, and the vapor output, and finally exits from the mouthpiece.

5. The E-liquid separation mechanism of claim 3, wherein a connection between the battery and the vaporizer base comprises:

a T-shaped groove connector;

a dovetail shaped slot connector;

a magnetic attachment connector;

a threaded connector; and a multi-threaded connector.

6. The E-liquid separation mechanism of claim 3, wherein the E-liquid separation control handler is positioned on the heating element base to operate the E-liquid separation mechanism when the E-liquid storage tank assembly is in the down position, wherein the user rotates the heating element base from the first position to the second position to turn on the E-liquid flow and from the second position to the first position to turn off the E-liquid flow.

7. The E-liquid separation mechanism of claim 3, wherein the one or more heating elements comprise a positive terminal electrically coupled to a positive terminal of the battery through the positive terminal of the vaporizer base, and a negative terminal electrically coupled to a negative terminal of the battery through the negative terminal of the vaporizer base.

8. The E-liquid separation mechanism of claim 1, wherein the one or more heating elements comprise:

one or more grid shaped heating elements;

one or more mesh shaped heating elements;

one or more net shaped heating elements;

one or more spiral heating elements; and any combination thereof.

9. The E-liquid separation mechanism of claim 1, wherein the cylindrical E-liquid storage medium comprises:

cotton fibers;

polypropylene fibers;

terylene fibers;

nylon fibers; and porous ceramic materials.

10. An electronic cigarette, comprising:

an E-liquid separation mechanism, wherein the E-liquid separation mechanism comprises:

an E-liquid storage tank assembly having an E-liquid storage tank storing E-liquid and an E-liquid storage tank base, wherein the E-liquid storage tank base defines a first E-liquid storage tank base opening, and a second E-liquid storage tank base opening; and a vaporizer assembly having a heating element base having one or more heating elements, wherein the heating element base defines a first vaporizer E-liquid opening and a second vaporizer E-liquid opening, wherein the E-liquid storage tank assembly and the vaporizer assembly are slidedly and rotatably connected through an E-liquid storage tank connector and a silicone gel sealing cover, and when a user uses the electronic cigarette, the user pushes the E-liquid storage tank assembly down from an up position when the E-liquid storage tank assembly is determined to be in the up position, and rotates the vaporizer assembly using an E-liquid separation control handler from a first position to a second position when the E-liquid storage tank assembly is determined to be in the first position such that the first E-liquid storage tank base opening and the second E-liquid storage tank base opening coincide with the first vaporizer E-liquid opening and the second vaporizer E-liquid opening, respectively, and the E-liquid in the E-liquid storage tank flows into a cylindrical E-liquid storage medium to be vaporized by the one or more heating elements through E-liquid paths formed between the first E-liquid storage tank base opening and the first vaporizer E-liquid opening, and the second E-liquid storage tank base opening and the second vaporizer E-liquid opening, respectively.

11. The electronic cigarette of claim 10, wherein the E-liquid storage tank assembly further comprises:

the E-liquid storage tank storing the E-liquid between an external tube and an internal tube, wherein the internal tube forms a vapor output;

a mouthpiece positioned on a top end of the E-liquid storage tank and connected to the vapor output; and an E-liquid storage tank sealing ring to prevent the E-liquid from the E-liquid in storage tank from leaking into the vaporizer assembly.

12. The electronic cigarette of claim 10, wherein the vaporizer assembly further comprises:

a vaporizer cover to cover the cylindrical E-liquid storage medium;

the one or more heating elements connected to a positive terminal, and a negative terminal to receive electrical power from a battery to vaporize the E-liquid in the cylindrical E-liquid storage medium, wherein the one or more heating elements are positioned on the heating element base having a first vaporizer air intake, and a second vaporizer air intake;

a heating element sealing ring to prevent the E-liquid in the cylindrical E-liquid storage medium from leaking out of the vaporizer assembly; and a vaporizer base defining a first vaporizer base air intake and a second vaporizer base air intake to allow outside air to flow into the vaporizer assembly.

13. The electronic cigarette of claim 12, wherein when the user pushes down the E-liquid storage tank assembly to the down position, and rotates the vaporizer assembly from the first position to the second position to allow the E-liquid in the E-liquid storage tank to flow into the cylindrical E-liquid storage medium, turns on an electrical power supply and sucks from the mouthpiece, outside air flows through the first vaporizer base air intake and the second vaporizer base air intake into the two airflow paths, goes up to the cylindrical E-liquid storage medium and the one or more heating elements, and the vapor output, and finally exits from the mouthpiece.

14. The electronic cigarette of claim 12, wherein a connection between the battery and the vaporizer base comprises:

a T-shaped groove connector;

a dovetail shaped slot connector;

a magnetic attachment connector;

a threaded connector; and a multi-threaded connector.

15. The electronic cigarette of claim 12, wherein the E-liquid separation control handler is positioned on the heating element base to operate the E-liquid separation mechanism when the E-liquid storage tank assembly is in the down position, wherein the user rotates the heating element base from the first position to the second position to turn on the E-liquid flow and from the second position to the first position to turn off the E-liquid flow.

16. The electronic cigarette of claim 12, wherein the one or more heating elements comprise a positive terminal electrically coupled to a positive terminal of the battery through the positive terminal of the vaporizer base, and a negative terminal electrically coupled to a negative terminal of the battery through the negative terminal of the vaporizer base.

17. The electronic cigarette of claim 10, wherein the one or more heating elements comprise:

one or more grid shaped heating elements;

one or more mesh shaped heating elements;

one or more net shaped heating elements;

one or more spiral heating elements; and any combination thereof.

18. The electronic cigarette of claim 10, wherein the cylindrical E-liquid storage medium comprises:

cotton fibers;

polypropylene fibers;

terylene fibers;

nylon fibers; and porous ceramic materials.

19. A method of using an electronic cigarette having an E-liquid separation mechanism, comprising:

determining, by a user, whether an E-liquid storage tank assembly is in an up position;

pushing down, by the user, the E-liquid storage tank assembly against a vaporizer assembly from the up position to a down position, when the E-liquid storage tank assembly is determined to be in the up position;

determining, by the user, whether the E-liquid storage tank assembly is in a first position;

rotating, by the user, the E-liquid storage tank assembly against the vaporizer assembly from the first position to a second position, when the E-liquid storage tank assembly is determined to be in the first position such that a first E-liquid storage tank base opening and a second E-liquid storage tank base opening defined on a vaporizer base of the vaporizer assembly coincide with a first vaporizer E-liquid opening and a second vaporizer E-liquid opening defined on a heating element base, respectively, and the E-liquid filled in an E-liquid storage tank flows into a cylindrical E-liquid storage medium to be vaporized by one or more heating elements through E-liquid paths formed between the first E-liquid storage tank base opening and the first vaporizer E-liquid opening, and the second E-liquid storage tank base opening and the second vaporizer E-liquid opening, respectively;

turning on, by the user, an electrical power supply to provide electrical power to the one or more heating elements of the vaporizer assembly to vaporize the E-liquid flowed to the cylindrical E-liquid storage medium; and sucking, by the user, E-liquid vapor from the vaporizer assembly through a mouthpiece, wherein air outside of the electronic cigarette enters the vaporizer assembly through a first vaporizer air intake and a second vaporizer air intake to be vaporized by the vaporizer assembly, and the vapor formed by the vaporizer assembly exits through a vapor output and the mouthpiece.

20. The method of claim 19, wherein when the user finish using the electronic cigarette, the method further comprises:

determining, by the user, whether the E-liquid storage tank assembly is in the second position;

rotating, by the user, the E-liquid storage tank assembly against the vaporizer assembly from the second position to the first position, when the E-liquid storage tank assembly is determined to be in the second position; and pulling up, by the user, the E-liquid storage tank assembly against the vaporizer assembly from the down position to the up position to terminate the E-liquid flow and separate the E-liquid in the E-liquid storage tank from the cylindrical E-liquid storage medium.

* * * * *